United States Patent [19]

Rossouw et al.

[11] Patent Number: 4,844,364

[45] Date of Patent: Jul. 4, 1989

[54] ROTARY IMPACT CRUSHER

[76] Inventors: Pieter J. Rossouw; Jan H. Rossouw, both of 31 Newton Road, Uraniaville, Klerksdorp, Transvaal Province, South Africa

[21] Appl. No.: 203,305

[22] Filed: Jun. 6, 1988

[51] Int. Cl.[4] ..... B02C 19/00

[52] U.S. Cl. ..... 241/275

[58] Field of Search ..... 241/5, 275, 292.1, 300, 241/300.1

[56] References Cited

U.S. PATENT DOCUMENTS 2,992,784 7/1961 Behnke et al. ..... 241/275

3,148,840 9/1964 Behnke ..... 241/275

*Primary Examiner*—Timothy V. Eley

*Attorney, Agent, or Firm*—Darby & Darby

[57] ABSTRACT

This invention relates to rotary impact crushers designed to provide a lining of rock to the crusher chamber walls against which crushing can take place and more particularly a lining of arcuate shape in vertical cross-section so that rock rebounding from the lining tends to follow the arcuate shape and follow a downward path towards and across that of the rock discharged from the rotor outlets.

4 Claims, 4 Drawing Sheets

ROTARY IMPACT CRUSHER

This invention relates to rock crushers wherein a feed of rock is accelerated and caused to strike a breaker wall to comminute the rock.

BACKGROUND TO THE INVENTION

The type of crusher is well known and this invention applies particularly to the kind having a rotor driven about a vertical axis. A feed of rock is caused to fall axially into the rotor to discharge radially therefrom at high speed. This accelerated rock strikes the wall of a crusher chamber around the rotor where it breaks into smaller pieces which fall from the crusher chamber for collection and possibly further treatment. It is to be understood that the term "rock" as used in this specification is to be interpreted as including any material which may be broken from larger to smaller pieces in the manner described.

In the very nature of things these crushers are subjected to conditions of heavy wear due to abrasion and impact forces which occur. This results in the need to use expensive hard wearing components and also necessitates replacement of worn components.

Today the majority of rotary crushers of this type are self-lining in that the rock being crushed forms a lining on the crusher chamber wall and against which feed material is discharged to be broken into smaller pieces while also breaking the pieces forming the lining. During use this lining is self-replacing and it is desirable that as much of the surface of the crusher that is subject to wear be made to have this automatic formation of rock lining as possible. Also it is obviously desirable to have the components subjected to wear easily replaceable. These are particularly the rotor exit and top and bottom plate linings and the ring feed inlet to the rotor.

Access to wear-prone parts for inspection is, with known units, difficult to achieve and maintenance inspection is virtually impossible. This is undesirable as work on crushers of the type referred to is frequently undertaken by unskilled labour.

The object of the present invention is to provide a crusher of the above type which is effective in use and which can be easily maintained and repaired when necessary.

SUMMARY OF THE INVENTION

According to this invention there is provided a rotary impact crusher including a crusher chamber with a device enabling the complete inner wall to be lined with rock being crushed during use.

Further features of this invention provide a rotary impact crusher in which the crusher chamber has an upstanding rim around a circular outlet opening and a radial lip located vertically adjacent the upper plate of the rotor extending outwardly from the rotor around a circular inlet opening into the chamber. The crusher chamber includes gusset plates extending in a radial direction with reference to the rotor regularly spaced around the chamber and extending the depth thereof. The chamber is square in a plan view.

The invention also provides a rotary impact crusher wherein the inlet opening permits a flow of material to be crushed into the crusher chamber adjacent the rotor outlets.

Still further features of this invention provide a method of rotary impact crushing wherein feed material to be crushed axially into a rotor, comprising rotating the rotor to discharge the material through outlets on the periphery of the rotor into a crusher chamber lined with material being crushed such that the lining extends around the surface of the crushing chamber in a substantially arcuate shape in cross-section.

BRIEF DESCRIPTION OF THE DRAWINGS

Other advantages and features of the invention are described with reference to preferred embodiments which are intended to illustrate and not to limit the invention and in which.

Figure 1:
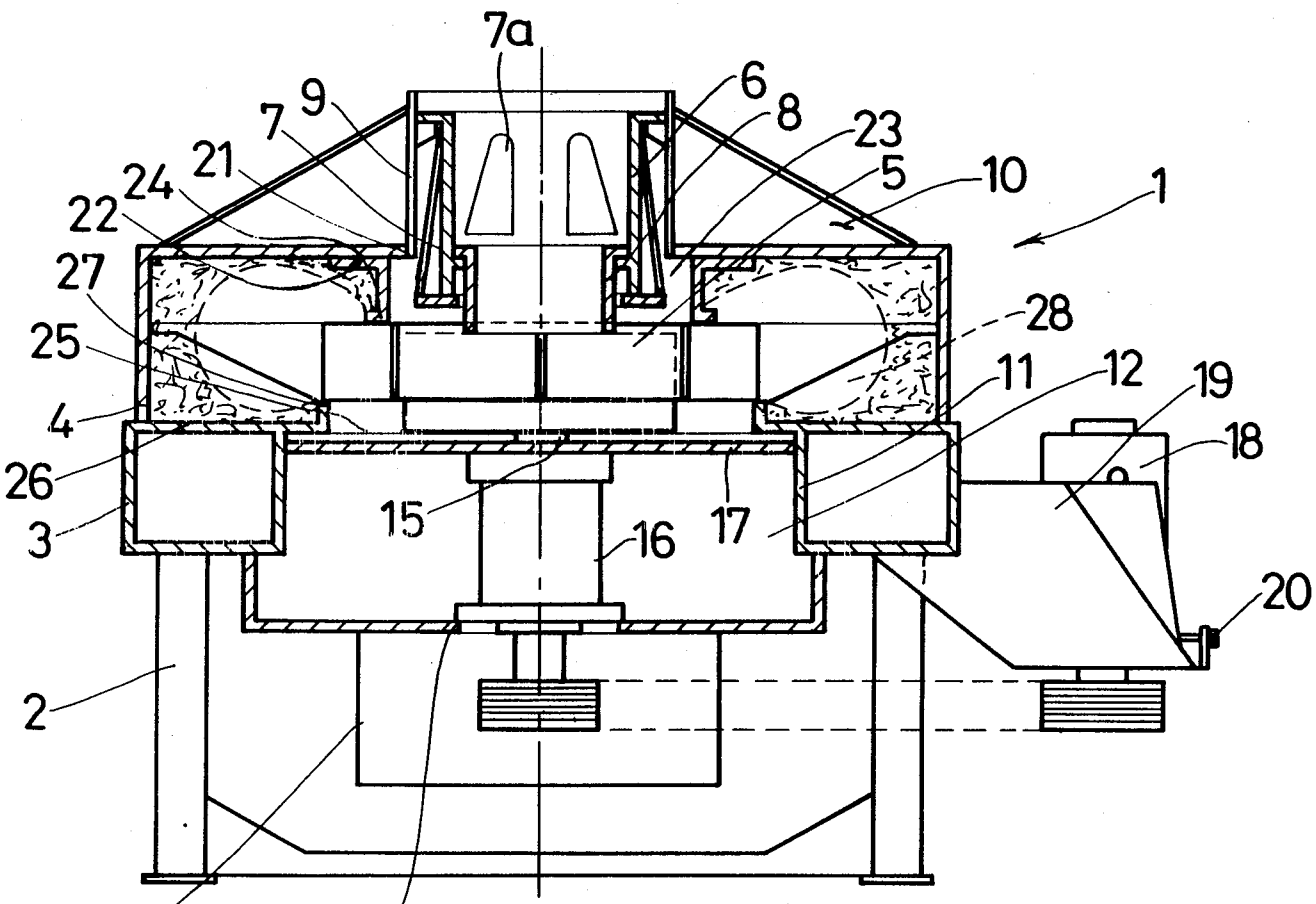
FIG. 1 is a vertical cross-section through the impact chamber.
Figure 2:
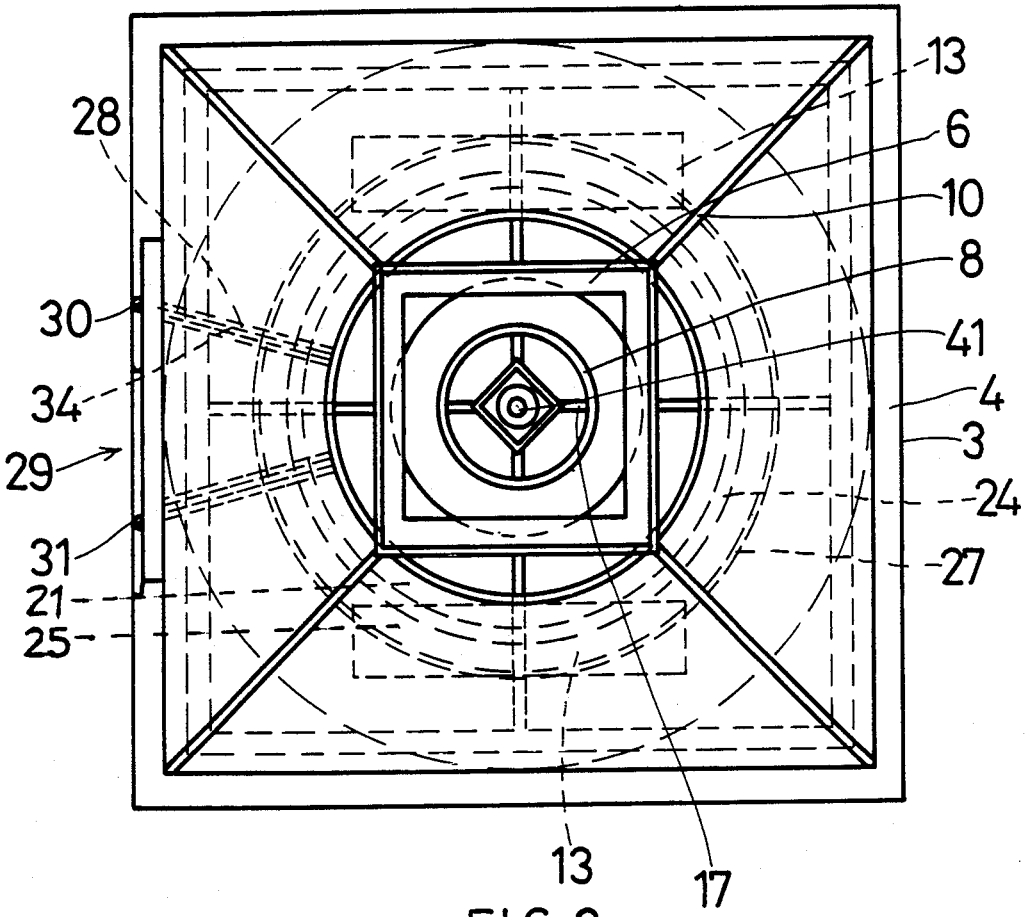
FIG. 2 is a plan of the crusher.
Figure 3:
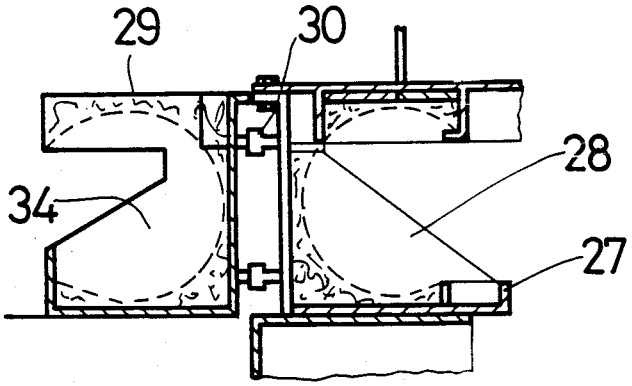
FIGS. 3 and 4 details of the inspection door.
Figure 4:
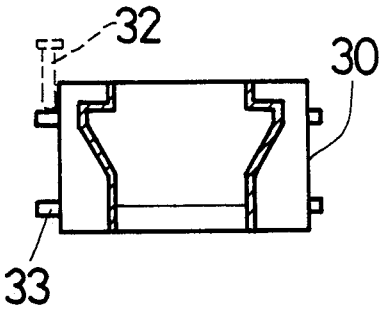
Figure 5:
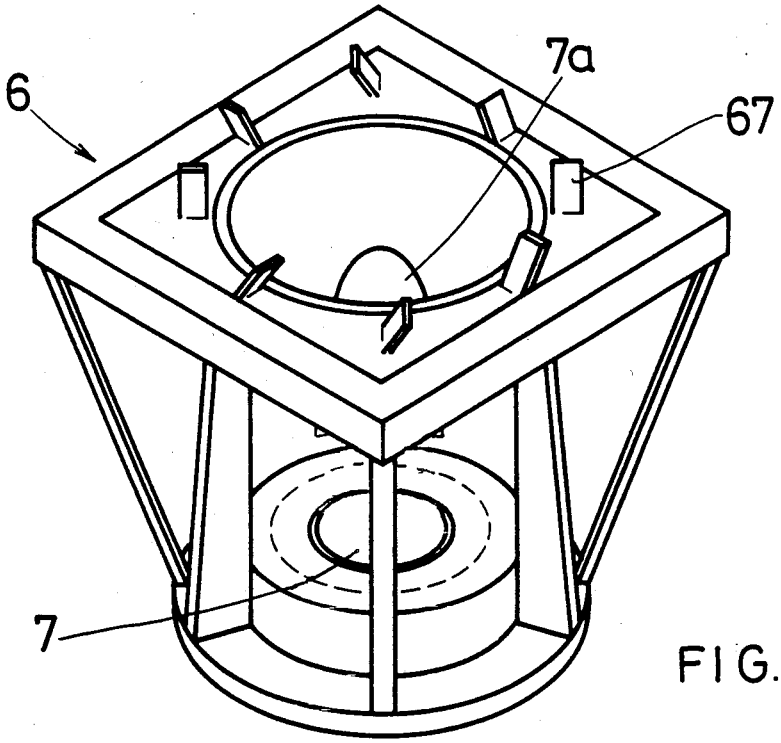
FIG. 5 an oblique view of the inlet chute.
Figure 6:
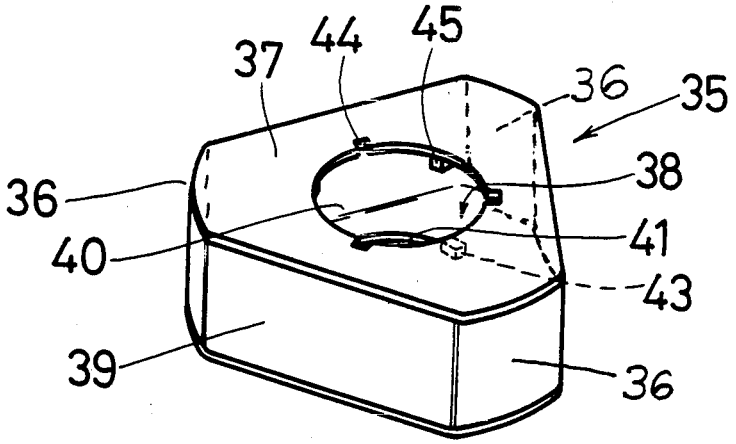
FIG. 6 an oblique view of the rotor.

DETAILED DESCRIPTION OF A PREFERRED EMBODIMENT OF THE INVENTION WITH REFERENCE TO THE DRAWINGS

Although a specific embodiment of the invention will now be described with reference to the drawings, it should be understood that the embodiment shown is by way of example only and merely illustrative of but one of the many passible specific embodiments which can represent applications of the principles of the invention. Various changes and modifications, obvious to one skilled in the art to which the invention pertains, are deemed to be within the spirit, scope and contemplation of the invention as further defined in the appended claims.

As illustrated in the drawings the crusher 1 has a rigid supporting stand 2 carrying a box-like frame 3.

On the frame 3 is mounted the crusher chamber 4 in which is centrally located the rotor assembly 5. Also centrally located with respect to the crusher chamber and co-axial with the rotor assembly 5 is feed chute 6 having an axial outlet 7 in which is supported an inlet tube 8 opening into the feed ring of the rotor assembly 5. The feed chute also has a plurality of outlets 7A through the wall thereof spaced above the upper end of the inlet tube 8. The feed chute 6 rests on retaining lugs in an upward extension 9 from the crusher chamber 4.

Bracing webs 10 extend from the extension 9 to the outer periphery of the top of the crusher chamber 4. These webs 10 have holes therein to facilitate lifting the crusher chamber 10 from the supporting frame 3 to which it is releasably secured preferably by bolting.

The frame 3 also provides part of the wall 11 of a collection compartment 12 which has large outlet openings 13 in the floor thereof enabling crushed material to fall into discharge chutes 14 from whence the material can be carried by a suitable conveyor belt arrangement (not shown). The discharge chutes 14 are made to accommodate the usual necessary inclination of the conveyor belt arrangement.

The discharge chutes 14 are located on opposite sides of the rotor drive shaft 15 which passes through the collection compartment 12 within a suitable shrouding 16. The top of compartment 12 is open but the shrouding 16 is supported by a spider indicated at 17.

The drive shaft 15 is driven by a suitable motor 18 through a vee-belt drive. In larger installations and where using an electric motor drive it is preferable to use a pair of motors opposite each other to drive the drive shaft 15 in unison. Each motor will be mounted on a cradle 19 rigidly secured to the frame 3. Adjustment bolts 20 enable the tension of the belt drive to be easily and accurately controlled.

The shrouding 16 will preferably house a replaceable unit which will include bearings and seals together with appropriate lubrication so that repair of any worn bearings can be easily effected by replacing the entire unit. The unit replaced can be stripped and repaired where appropriate workshop facilities are available.

In the example illustrated the crusher chamber 4 is square. It has a circular opening 21 with an inwardly extending flange 22. This flange 22 is located so that there is a space 23 between the outside of the feed chute 6 through which a secondary flow of material to be crushed can fall from the outlets 7 over the edge of the rotor assembly 5 in the crusher chamber 4. The free end of the flange 22 carries an outwardly directed circumferential lip 24 which is arranged to lie on substantially the same plane as the upper edge of the outlets from the rotor assembly 5.

The outlet 25 from the crusher chamber 4 is of larger diameter than the inlet opening 21 and provides an annular space between the floor 26 of the chamber 4 and the rotor assembly 5 through which material subjected to the crushing operations can pass into the collection compartment 12. The edge of the outlet 25 carries an upstanding rim 27.

Gusset plates 28 spaced apart at regular intervals around the crusher chamber 4 extend between the rim 27 and the outer wall of the crusher chamber 4 at a height level with the lip 24.

While the crusher chamber above described is square in shape it will be understood that this is not essential. It could be made any other convenient shape but is easily fabricated to square shape from heavy guage steel plate.

Part of one side wall of the crusher chamber 4 is formed as an inspection door 29. The door 29 is carried on heavy supporting hinges 30 on the outside of chamber 4 and the securing bolt assembly 31 is of similar heavy construction with a removable bolt 32 engaging in vertical holes provided to aligned lugs 33 carried by the door and the outer wall of chamber 4.

The door 29 carries inwardly directed gusset plates 34 extending from each side of the door and are arranged so that when the door 29 is in the closed position these gusset plates 34 will lie one against each of a pair of adjacent gusset plates 28 in the crusher chamber 4. The gusset plates 34 do not extend the full length of those 28 and stop short of the rim 27. Top and bottom plates join the upper and lower edges of the gusset plates 34.

The door assembly forming part of the crusher chamber wall has the great advantage that inspection and maintenance of the wear parts of the rotor assembly 5 is greatly facilitated compared with other comparable rotary crushers. Part of the crushing bed (described below) which forms from rock being crushed against the wall of the chamber 4 during use remains intact when the door is open. The door extending the full height of the chamber 4 enables ready inspection of and access to the wear parts in the rotor assembly where many of these parts can be replaced and welding operations conducted without the necessity to remove the rotor assembly 5. All the wear parts in the rotor assembly which are commonly repaired or replaced can be reached either through the door or by simply lifting the inlet tube 8 and feed chute 6 from the top of the crusher 1.

The wide access areas provided in the crusher construction according to this invention also enable proper supervision of repairs and replacements to be undertaken.

The rotor assembly 5 consists of sa rotor 35 which is constructed to generally triangular shape in plan view. The rotor is a balanced construction and equiangular. Outlet openings 36 are provided at the apices of the trangular shape.

The rotor has upper and lower plates 37 and 38 spaced apart by vertical side walls 39 and an inlet opening 40 made centrally through the upper plate 37.

The lower plate 38 is adapted to be secured to the drive shaft 15 preferably in known manner using a taper lock coupling. A shaft end cover in the form of a conical wear resistant component 41 is fixed to the end of the shaft 15 so that material to be crushed cannot come into contact with shaft assembly. This component 41 deflects the material fed into the rotor towards the outlets.

The rotor can conveniently be made of heavy gauge mild steel to the outer surface of which is applied a hard facing material in known manner.

To protect the inlet 40 the feed ring 42 is provided. This ring 42 fits into the inlet opening 40 and locking lugs 43 pass through complementary notches 44 provided through the top plate 37 of the rotor 35. Stops 45 are welded to the under surface of the top plate 37 against which lugs 43 abut to locate the feed ring 42 with respect to the rotor 35 during use. The ring 42 is supported on the rotor top plate 37 by a peripheral flange 46 on the feed ring. The part 47 of the feed ring 42 extends around the outlet from the inlet tube 8.

The lower part 48 of the feed ring extends below the top plate 37 of the rotor 35 and has recesses 49 which are located opposite the rotor outlets 36. These recesses 49 have peripherally extending notches 50 in their side walls and extend from the bottom of the ring to below the flange 46. Complementarily shaped wear inserts 51 of slightly greater overall depth fit into the recesses 49 and abut against the wall of the inlet opening 40 through the top plate 37. These inserts 51 have been found in practice to abort most of the excessive wear on the feed ring during use. Thus their replacement from time to time avoids the necessity for the replacement of the complete feed ring and this replacement can be affected by removing the feed chute 6 and inlet tube 8. Also making the inserts of greater depth than the notches to extend below the remainder of the feed ring accommodates to a further degree the excessive wear which takes place over these areas.

The internal surfaces of the upper and lower plates 37 and 38 are also provided with wear resilient liners. A study of the wear pattern with the rotor of this invention has enabled the liners to be made in two approximately radially extending parts 52 and 53. The parts 53 are fixed to the plates 37 and 38 preferably be welding while the parts 52 are removable. The parts are shaped so that the edge of part 53 adjacent part 52 is undercut to support a projecting tapered edge 54 along the length of the part 52.

The opposite edge 55 of part 52 has a shoulder 56 which engages a support 57 which is welded to extend from the inside of the rotor 35. These supports 57 extend the full length of the part 52 from the top plate lining because the parts 52 can be fitted by sliding them into position from the inlet opening against the under surface of the top plate 37. However the conical component 41 protecting the end of the drive shaft 15 prevents the lower parts 52 being inserted in a similar manner.

The supports 57 are made as a plurality of separate members and the shoulders 56 of the parts 52 are notched in such a manner that the parts 52 can be fitted by tilting the part 52 to have its tapered edge engage under the part 53 and then allow the part 52 to lie against the bottom plate by passing the supports 57 through the notches in the shoulders 56. The part 52 can then be slid radially outwardly to bring it into its required position during use. The notches in the shoulders and the supports will be positioned to enable the above movements to be achieved.

To remove the parts 52 the movements described are reversed.

Figure 7:
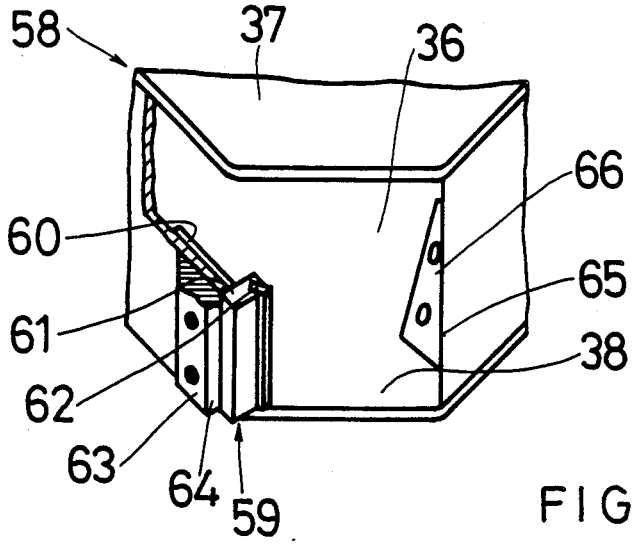
FIG. 7 a detail of the wear tip assembly.
Figure 8:
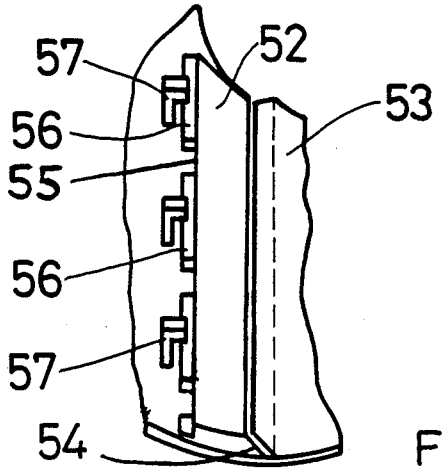
FIG. 8 a detail of the lower rotor plate liner.
Figure 9:
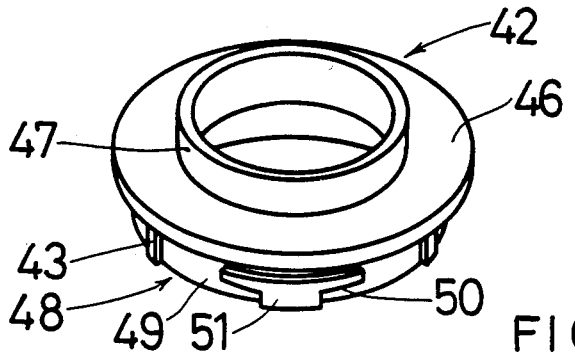
FIG. 9 a detail of the feed ring.

The outlets 36 from the rotor 35 each include a wear tip assembly indicated generally at 58. This assembly is fitted to the trailing edge of the outlet opening and extends the full height of that opening. The main wear tip 59 is made in two parts, one above the other only one part of which is indicated in FIG. 7. Each part of wear tip 59 consist of a backing plate 60 to which is welded a carrier block 61 to project from one end of the plate 60 and to form a step which extends beyond the surface of the plate 60. A slot is formed in the block at an angle of about 45° to the plane of the plate 60 and tungsten carbide tips 62 are brazed into position in the slots. The plate 60 is perforated to accommodate mounting bolts.

The plate 60 is positioned against the inner wall of the rotor and on the outer face of the rotor there is provided a heavy back up tip 63. This has a chamfered leading edge 64 which locates behind the block 61 with the rotor plate clamped by bolts extending through the mounting and rotor plates and back up tip 63.

The liner parts 52 have their radially outer ends set away to accommodate the wear tip 59.

The leading edge 65 of the outlet opening 36 is provided with a radially inwardly directed lip 66. This lip is tapered from one end to the other and, while it is subjected to little wear during use the taper has the effect of controlling the discharge from the opening 36 with which it is associated. When the wider part of the lip 66 is against the lower plate 38 of the rotor the main discharge stream is raised. When the lip is reversed the main discharge takes place at a lower level. In this way the action of the rotor can be controlled to give the best discharge with least wear depending on material being crushed and other prevailing operating conditions.

In use the crusher operates in a well known manner by the rotor being driven to discharge rock fed axially therein against the wall of the crusher chamber. A lining of rock builds up automatically against the wall of the chamber into a circular shape and this lining of rock provides the wall against which rock thrown from the rotor is crushed. The wall is continually worn away and replaced.

An important feature of the invention is the provision of the lip 24 and the rim 27. These components ensure that the build up of rock in the crusher chamber extends completely around the crusher chamber wall from the lip 24 round to the rim 27. The effect of this is not only to prevent wear of the chamber wall but also results in the crushed rock discharging from the chamber in a predominantly downward direction towards the outlet 25 extending around the bottom of the rotor. This materially reduces the wear on the rotor.

As the axial feed is built up rock also flows out of the openings through the side wall of the feed chute 6 where it builds up a ramp inlet excess material flows past the flange 22 and through space 23. From there it drops downwardly adjacent the edge of the rotor to be violently contacted by the rock being discharged from the rotor at high speed. This gives the known additional crushing action which is obtained by having two feeds into the crusher.

The design of the crusher according to this invention is made so as to use as far as possible an automatic lining of wearing parts with rock being crushed.

Particular reference is made to the step formed by the carrier block 61 which traps rock behind the trailing edge of the outlet opening 36 thus confining wear to the main wear lips 59. As described these lips 59 are made in pairs. Most of the wear takes place near the middle of the outlet and as the lips become worn their positions may be reversed so that complete use of the expensive tungsten material can be made before new wear lips 59 need be fitted to the crusher. The build up behind the lips also protects the supports 57 for the liner parts 52 against wear.

The triangular shape to the rotor not only reduces the material used and weight of the rotor but also keeps wear of the hard faced outer surfaces to a minimum. Also in the event of a build up of material in the crusher chamber causing rapid excessive wear of the rotor to an extent equivalent to the thickness of the side wall of the rotor, there is no danger of the rotor disintegrating. With a circular rotor this danger is inherent because once wear of this nature takes place the rotor upper plate is no longer connected to the lower plate. This can lead to disastrous results to the crusher and danger to the operators.

The draught caused by the rotor tends to cause air to be blown back through the crusher outside the feed chute 6 and to minimise this undesirable effect vanes 67 are fitted near the top of the feed chute to deflect this air flow back into the crusher.

Also the rotor is caused to rotate in an anticlockwise direction and this together with the centrifugal forces exerted by the rotor movement ensure that the feed ring 42 with its wear inserts 51 and the liner parts 52 are held in position during use without securing means. This further facilitates repair and replacement of these parts by unskilled labour.

The complete crusher is of simple but effective construction and has been found to be both effective and durable even under extremely arduous conditions.

What I claim as new and desire to secure by Letters Patent is:

1. A rotary impact crusher comprising:

a crusher chamber with means for enabling an inner wall thereof to be lined with rock being crushed during use, and a rotor having peripheral outlets therein disposed in the crusher chamber, the crusher chamber further including gusset plates extending in a radial direction with reference to the rotor, the gusset plates being regularly spaced around the chamber and extending from an upper portion to a lower portion thereof.

2. The rotary impact crusher of claim 1, wherein the rotor includes an upper plate, and wherein the crusher chamber has a circular inlet opening and a circular outlet opening, the crusher chamber further comprising an upstanding rim around the circular outlet opening extending upwardly into the crusher chamber and a radial lip located at a lower end of the circular inlet opening and vertically adjacent the rotor upper plate, the lip extending outwardly from the rotor into the crusher chamber.

3. A rotary impact crusher as claimed in claim 1 in which the chamber is square in plan view.

4. The rotary impact crusher of claim 1 in which the inlet opening permits a flow of material to be crushed into the crusher chamber adjacent the rotor peripheral outlets.

* * * * *